United States Patent [19]

Kihara

[11] Patent Number: 4,817,162

[45] Date of Patent: Mar. 28, 1989

[54] BINAURAL CORRELATION COEFFICIENT CORRECTING APPARATUS

[75] Inventor: Hisashi Kihara, Saitama, Japan

[73] Assignee: Pioneer Electronic Corporation, Tokyo, Japan

[21] Appl. No.: 98,830

[22] Filed: Sep. 21, 1987

[30] Foreign Application Priority Data

Sep. 19, 1986 [JP] Japan ..... 61-143892

[51] Int. Cl.[4] ..... H04R 25/00; H04R 5/00

[52] U.S. Cl. ..... 381/97; 381/1; 381/17; 381/86

[58] Field of Search ..... 381/1, 2, 24, 26, 86, 381/17, 37

[56] References Cited

U.S. PATENT DOCUMENTS 3,947,635 3/1976 Frankman ..... 381/24
4,087,631 5/1978 Yamada et al. ..... 381/25
4,308,424 12/1981 Bice, Jr. ..... 381/17
4,449,229 5/1984 Mori ..... 381/2
4,638,505 1/1987 Polk et al. ..... 381/24

OTHER PUBLICATIONS

Tunable Active Crossover Networks, Mitra et al., J. Audio Eng. Soc., vol. 33, No. 10, Oct. 1985, pp. 762–769.

Japanese Unexamined Patent Application No. 57-184400.

*Primary Examiner*—Jin F. Ng
*Assistant Examiner*—David H. Kim
*Attorney, Agent, or Firm*—Sughrue, Mion, Zinn, Macpeak & Seas

[57] ABSTRACT

An acoustic apparatus for correcting the binaural correlation coefficient of a stereo audio signals, particularly for use in automobiles.

The signal in at least one of the channels is phase shifted in the frequency range of 200 to 600 Hz.

3 Claims, 3 Drawing Sheets

BINAURAL CORRELATION COEFFICIENT CORRECTING APPARATUS

BACKGROUND OF THE INVENTION

1. Field of the Invention

The present invention generally relates to an inter-ear or binaural correlation coefficient correcting apparatus. It particularly relates to a correction circuit in which a coefficient of correlation between the right and left ears of a listener especially in a car is corrected so as to eliminate unnatural sound localization.

2. Background of the Invention

A time interval between when the right and left ears of a person receive a sound wave has a close relationship to the frequencies of the sound waves which reach the ears. That is, a phase difference of sound waves which reach the right and left ears is specifically affected by a low frequency component of a wavelength substantially the same as the interval between the right and left ears and has a peculiar directional pattern. A person can recognize a spatial sound impression owing to a binaural level difference, a binaural phase difference, a directional pattern, etc., of sound waves which reach both ears.

Such a binaural correlation may be repesented by the following expression of a binaural correlation coefficient $\rho_{LR}$:

$$\rho_{LR} = \frac{[P_L(t) \cdot P_R(t)]}{\sqrt{[\{P_L(t)\}^2] \cdot [\{P_R(t)\}^2]}} \quad (1)$$

where the symbols $P_L(t)$ and $P_R(t)$ represent sound pressure applied to the right and left ears respectively, and $[P_L(t)]$ and $[P_R(t)]$ represent time averages of these sound pressures.

When the expression (1) is applied to a general listening room, the value of the binaural correlation coefficient $\rho_{LR}$ is about 1, that is, sound waves transmitted to the right and left ears are in phase within a lower medium frequency sound range, whereas in a high frequency sound range, on the contrary, there is a tendency that the value of the binaural correlation $\rho_{LR}$ approaches zero because the sound wavelength in a high sound range is shorter than the interval between the right and left ears so that there is no correlation in the phase relationship.

When the above-mentioned expression (1) is applied to the inside of a car compartment, the binaural correlation coefficient $\rho_{LR}$ at a listener's sitting position in the car compartment takes such a measured value as shown by a dotted line in FIG. 3, owing to the reflection of sounds in the car compartment and asymmetry of the sound source and of the sound space with respect to the listener's sitting position. As apparent from the measured value shown in FIG. 3, there arises a phenomenon in a lower medium frequency sound range that the value of the binaural correlation coefficient $\rho_{LR}$ becomes negative, that is, the phase between the right and left ears is inverted. This phase inversion causes sound twining unclear feeling of sound localization, so that the listener feels that the sounds are unpleasant.

In order to correct such a $\rho_{LR}$ characteristic as described above, a technique shown in FIG. 7 has been proposed. In FIG. 7, there are provided two signal paths. A signal applied to an input terminal 7 of one of the signal paths is simultaneously fed to each of a low-pass filter 1 and high-pass filters 2 and 4, which separate a frequency range into two frequency bands. Further, the high-pass filter 2 together with a low-pass filter 3 constitute a band-pass filter to allow necessary frequency components to pass therethrough so as to be applied to a phase inverter circuit 5 which inverts the phase of the signal components in this frequency band. The signals passed through the respective filters are added to one another by an adder 6 and the output of the adder 6 is applied to an output terminal 9.

The other signal path allows the signal to pass therethrough as it is from an input terminal 8 to an output terminal 10.

By using such a correction circuit, it is possible to provide a phase difference to signals applied to a right and a left speaker. However, a filter circuit for separating the band to be corrected must be used so that not only is the circuit made complicated but undulations are caused in a frequency characteristic of the signals when the signals are added in the adder 6.

SUMMARY OF THE INVENTION

It is therefore an object of the present invention to eliminate such disadvantages as described in the prior art.

In order to attain the above object, according to the present invention, the binaural correlation coefficient correction apparatus comprises a phase shifter provided in at least one of respective signal paths of a right and a left channel of an acoustic equipment and which shifts a phase of a signal in a predetermined frequency band.

Preferably, the phase shifter shifts a phase of a signal in a frequency band of from 200 Hz to 600 Hz.

BRIEF DESCRIPTION OF THE DRAWINGS

Other objects and advantages of the invention will become apparent during the following discussion of the accompanying drawings, wherein.

DETAILED DESCRIPTION OF THE PREFERRED EMBODIMENTS

Figure 1:
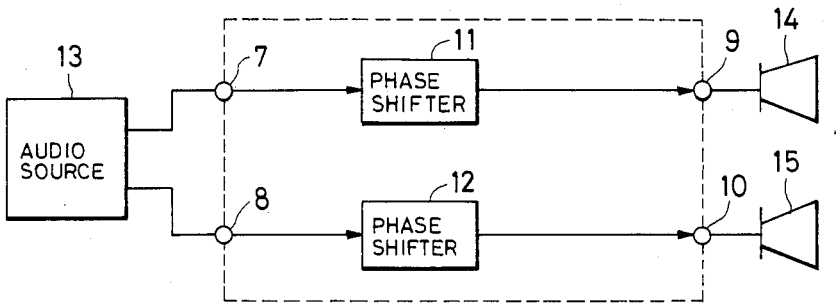
FIG. 1 is a block diagram showing an embodiment of the binaural correlation coefficient correlation apparatus according to the present invention.

Referring to FIG. 1, an embodiment according to the present invention will be described hereunder.

In the drawings, two signal input paths 7 and 8 for a right and a left channel are respectively provided with phase shifters 11 and 12, each of which in a specific frequency band shift a phase of a signal from a stereo audio source 13, such as a radio or tapedeck. The signals passed through the phase shifters 11 and 12 are led to respective output terminals 9 and 10 so as to be output as sounds from speakers 14 and 15.

Figure 2:
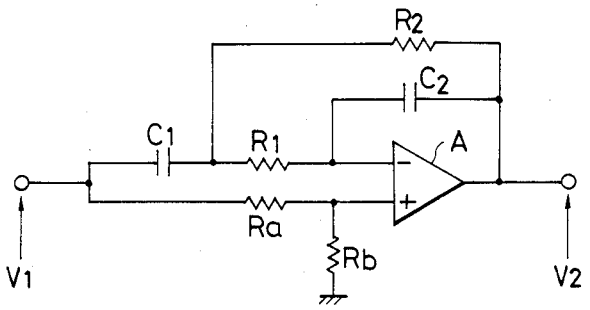
FIG. 2 is a circuit diagram of a phase shifter used in the apparatus of FIG. 1.

An example of a circuit of each of the above-mentioned phase shifters 11 and 12 is illustrated in FIG. 2.

An input $V_1$ is applied to an inverting input terminal of an operational amplifier A through a capacitor $C_1$ and a resistor $R_1$ and to a non-inverting input terminal of the operational amplifier A through a resistor $R_a$. The non-inverting input terminal of the operational amplifier A is grounded through a resistor $R_b$. The output of the operational amplifier A is fed back to the inverting input terminal through a capacitor $C_2$ and is fed back also to a junction between the capacitor $C_1$ and the resistor $R_1$ through a resistor $R_2$.

The transfer function of the circuit is given as follows:

$$\frac{V_2}{V_1} = \frac{1}{1+K} \times \frac{S^2 - \frac{R_1 + R_2}{R_1 \cdot R_2 \cdot C_1} S + \frac{1}{R_1 \cdot R_2 \cdot C_1 \cdot C_2}}{S^2 + \frac{R_1 + R_2}{R_1 \cdot R_2 \cdot C_1} S + \frac{1}{R_1 \cdot R_2 \cdot C_1 \cdot C_2}} \quad (2)$$

where $$K = \frac{R_a}{R_b}, \text{ and } \frac{C_2}{C_1} = \frac{K}{2} \cdot \frac{R_2}{R_1 + R_2}.$$

As is apparent from expression (2), the amplitude characteristic of this circuit is as follows:

$$\alpha(\omega) = \frac{1}{1+K} \quad (3)$$

Thus, the amplitude characteristic becomes independent of the frequency $\omega$, that is, the amplitude-frequency characteristic becomes flat.

The phase characteristic is as follows:

$$\beta(\omega) = 2\tan^{-1} \frac{\omega_0 \omega}{Q(\omega_0^2 - \omega^2)} \quad (4)$$

where $$\omega_0^2 = \frac{1}{R_1 \cdot R_2 \cdot C_1 \cdot C_2}, \text{ and } Q = \frac{2}{K} \cdot \sqrt{\frac{R_1 \cdot C_2}{R_2 \cdot C_1}}.$$

Figure 4:
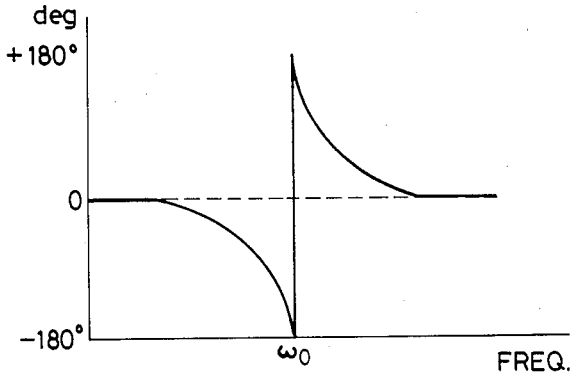
FIG. 4 is a characteristic diagram showing a principle of a phase shifter.
Figure 5:
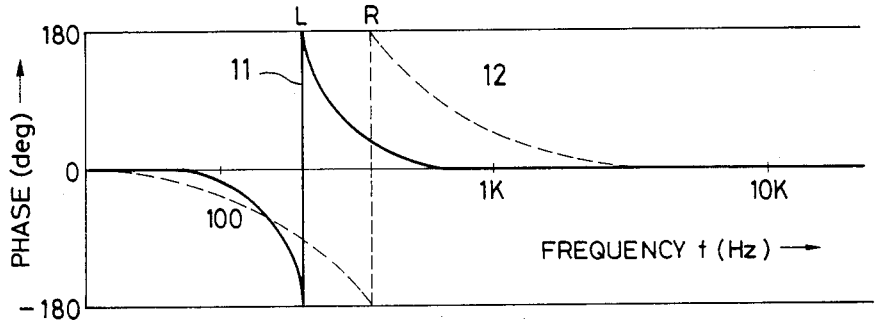
FIG. 5 is a characteristic diagram showing the phase shifter used in the apparatus of FIG. 1.
Figure 6:
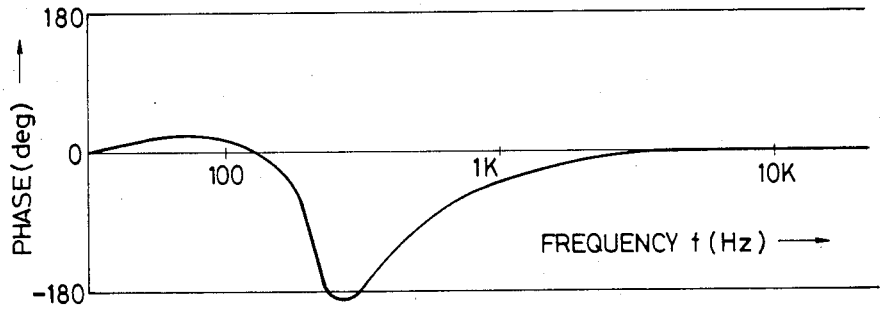
FIG. 6 is a characteristic diagram showing a corrected output.
Figure 7:
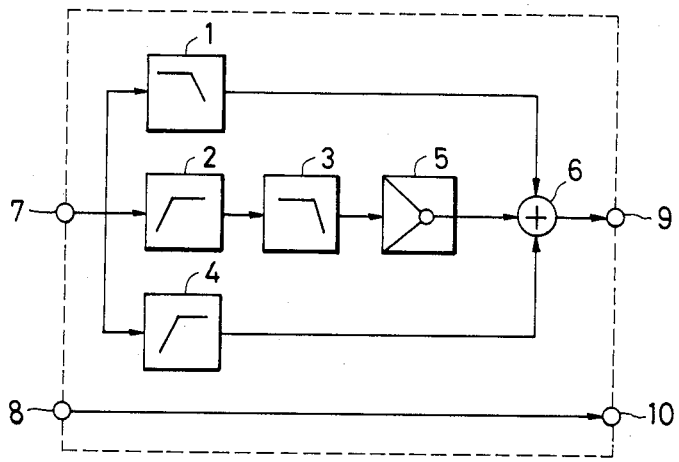
FIG. 7 PRIOR ART
FIG. 7 is a block diagram showing a conventional correction apparatus.

It can be understood that the phase-frequency characteristic of this circuit is such that the phase is inverted, as shown in FIG. 4 at a specific frequency $\omega_0$ which is determined by $R_1$, $R_2$, $C_1$, and $C_2$. Therefore, if the above-mentioned phase shifters are provided in the right and left channels respectively so as to adjust the values of Q and $\omega_0$ in both the right and left channels to establish the characteristic as shown in FIG. 5, the output signal characteristic is such that the phase of only the signal in the desired frequency band can be shifted as shown in FIG. 6 by a difference in phase between the right and left channels.

In that case, if the respective values of $\omega_0$ of the phase shifters are set to about 200 Hz and about 600 Hz in order to invert the phase in the lower medium frequency sound range, it is made possible to correct the disorder in phase in the low medium sound range in a car compartment.

Figure 3:
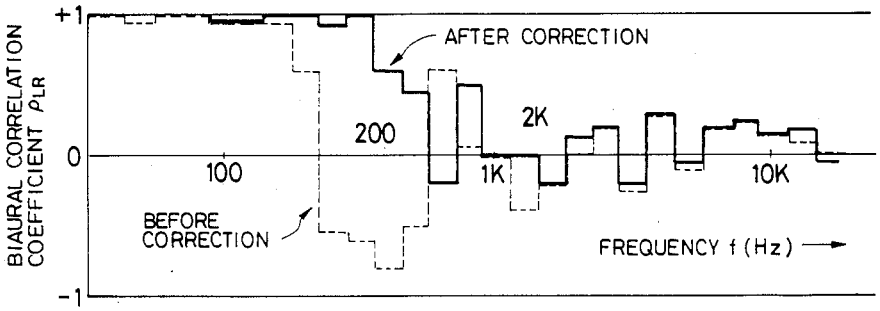
FIG. 3 is a graph showing a measured value of the binaural correlation coefficient in the apparatus of FIG. 1.

In FIG. 3, a measured value of the binaural correlation coefficient $\rho LR$ which is corrected by the phase shifters is shown by a solid line. As apparent from the measured value, it is understood that sounds are transmitted to the right and left ears under the condition that the binaural correlation coefficient $\rho LR$ is not inverted in the medium frequency sound range.

Although the two phase shifters 11 and 12 are provided respectively in the right and left channels in the above-mentioned embodiment, the phase shifter may be provided only one of the signal paths of the two channels.

In that case, the phase is not corrected in the high frequency sound range. However, there is no problem because the binaural correlation coefficient $\rho LR$ is zero (non-correlation) in the high frequency sound region as shown by a dotted line in FIG. 3.

As described above, in the binaural correlation coefficient correction apparatus according to the present invention, it is possible to correct the binaural correlation coefficient which is peculiar to a listener in a car compartment. Further, it is possible to expect an extremely natural listening feeling without requiring any complicated circuits such as filters.

What is claimed is:

1. An acoustic correction device, comprising:

a source of a right and a left channel of an audio signal; and means for separately shifting a phase of at least one of said right and left channels in a predetermined frequency band, wherein said shifting means includes separate signal paths for each of said right and left channels, a first phase shifter in a first one of said signal paths inverting a signal phase at a frequency of substantially 200 Hz and a second phase shifter in a second one of said signal paths inverting a signal phase at a frequency of substantially 600 Hz.

2. An acoustic device as recited in claim 1, wherein said predetermined frequency band is approximately 200 Hz to 600 Hz.

3. An acoustic device as recited in claim 1, wherein said shifting means operates with parameters selected to improve a biaural correlation coefficient of said right and left channels in an environment of said acoustic device.

* * * * *